US011737506B2

(12) United States Patent
Turnblom

(10) Patent No.: US 11,737,506 B2
(45) Date of Patent: Aug. 29, 2023

(54) FOOTWEAR PROTECTORS AND RELATED METHODS

(71) Applicant: Jacob Scott Turnblom, West Valley City, UT (US)

(72) Inventor: Jacob Scott Turnblom, West Valley City, UT (US)

( * ) Notice: Subject to any disclaimer, the term of this patent is extended or adjusted under 35 U.S.C. 154(b) by 0 days.

(21) Appl. No.: 17/444,177

(22) Filed: Jul. 30, 2021

(65) Prior Publication Data

US 2022/0031009 A1 Feb. 3, 2022

Related U.S. Application Data

(60) Provisional application No. 63/059,910, filed on Jul. 31, 2020.

(51) Int. Cl.
*A43B 3/18* (2022.01)
*A43B 5/14* (2006.01)

(52) U.S. Cl.
CPC ..... *A43B 3/18* (2013.01); *A43B 5/145* (2013.01)

(58) Field of Classification Search
CPC .... A43B 3/18; A43B 3/16; A43B 3/20; A43B 5/145; A43B 5/18
USPC ..... 36/131, 7.4
See application file for complete search history.

(56) References Cited

U.S. PATENT DOCUMENTS 1,199,236 A * 9/1916 Boyd ..... A41D 17/04 36/2 A
1,279,764 A * 9/1918 Savage ..... A41D 17/04 36/2 A
2,104,751 A * 1/1938 Le Fevre ..... A41D 17/04 36/2 A
4,411,077 A * 10/1983 Slavitt ..... A43C 11/004 36/114
4,766,682 A 8/1988 Malloy, III
4,991,318 A * 2/1991 Cornell ..... A43B 3/20 36/72 R
5,168,644 A * 12/1992 Ellis ..... A43B 5/145 36/131
5,311,679 A 5/1994 Birch, Sr.
5,671,517 A 9/1997 Gourley
D385,999 S 11/1997 Tong
6,000,111 A 12/1999 Deskins et al.
D453,413 S 2/2002 Tsujino et al.
6,601,323 B2 8/2003 Tsujimo et al.
D619,795 S 7/2010 McBride
(Continued)

FOREIGN PATENT DOCUMENTS

CA 2330215 A1 * 7/2002 ..... A43B 3/16
FR 2652487 A * 4/1991 ..... A43B 5/145
(Continued)

OTHER PUBLICATIONS

Translation of FR 2652487, Apr. 1991, Gerardin.*
(Continued)

*Primary Examiner* — Ted Kavanaugh
(74) *Attorney, Agent, or Firm* — Law Office of Paul B. Johnson; Paul B. Johnson

(57) ABSTRACT

A footwear protector includes an elastic layer, an abrasion-resistant layer coupled with the elastic layer, at least one fastener layer coupled with the elastic layer, and a coupler coupled with at least one of the layers and configured to couple with a portion of footwear.

12 Claims, 4 Drawing Sheets

(56) References Cited

U.S. PATENT DOCUMENTS

| | | | | |
|---|---|---|---|---|
| D670,074 | S | 11/2012 | Willows et al. | |
| 8,863,411 | B2 * | 10/2014 | Berger | A43B 7/1495 36/50.1 |
| D720,126 | S | 12/2014 | Goldman et al. | |
| D792,078 | S | 7/2017 | Greenspan | |
| D816,980 | S | 5/2018 | Chang | |
| D819,951 | S | 6/2018 | Lindsey | |
| D836,903 | S | 1/2019 | Lindsey | |
| D848,731 | S | 5/2019 | Ge | |
| D977,230 | S | 2/2023 | Laverty et al. | |
| D977,238 | S | 2/2023 | Johnson | |
| 2003/0089001 | A1 * | 5/2003 | Zagami | A43B 3/0078 36/131 |
| 2005/0144812 | A1 | 7/2005 | Wheeler | |
| 2006/0179684 | A1 * | 8/2006 | Levy | A43B 13/04 36/30 R |
| 2018/0263330 | A1 | 9/2018 | Rhoads | |
| 2020/0205524 | A1 | 7/2020 | Hatfield et al. | |
| 2023/0051747 | A1 | 2/2023 | Morgan | |

FOREIGN PATENT DOCUMENTS

| | | | | |
|---|---|---|---|---|
| GB | 974457 | A * | 11/1964 | |
| WO | WO-2015117179 | A1 * | 8/2015 | A43B 3/20 |

OTHER PUBLICATIONS

Shifter Skins boot protector product, offered online for sale in the U.S. at RYDEWEAR.com at least as early as Sep. 5, 2016, available online at https://web.archive.org/web/20160905115848/https://www.rydewear.com/collections/shifter-skinz, last visited Oct. 28, 2021.

Nelson Rigg Shift boot protector product, offered online for sale in the U.S. at REVZILLA.com at least as early as Sep. 29, 2015, available online at https://www.revzilla.com/motorcycle/nelson-rigg-shift-boot-protector?gclid=CjwKCAjwpMOIBhBAEiwAy5M6YKqldmGVajlm3Xcj1SXJdDYNE2-O2OBchE_t1RU0ksTVdz5ZzbssixoCqMcQAvD_BwE&sku_id=531694, last visited Oct. 28, 2021.

Coitak boot protector product, offered online for sale in the U.S. at AMAZON.com at least as early as Oct. 14, 2020, available online at https://www.amazon.com/Coitak-Motorcycle-Motorbike-Protector-Protective/dp/B08L6C11T3/ref=cm_cr_arp_d_product_top?ie=UTF8, last visited Oct. 28, 2021.

Chcycle boot protector product, offered online for sale in the U.S. at AMAZON.com at least as early as Sep. 11, 2017, available online at https://www.amazon.com/CHCYCLE-Shifter-Accessories-Motorcycle-Protector/dp/B075JXLMZ2/ref=sr_1_7?dchild=1&keywords=motorcycle+shoe+protector&qid=1628564352&sr=8-7, last visited Oct. 28, 2021.

Trip Machine shoe protector product, offered online for sale in the U.S. at AMAZON.com at least as early as Apr. 28, 2018, available online at https://www.amazon.com/Trip-Machine-Company-Leather-Protector/dp/B07CQNP1NG/ref=sr_1_22?dchild=1&keywords=motorcycle+shoe+protector&qid=1628564123&sr=8-22, last visited Oct. 28, 2021.

Badass Moto shoe protector product, offered online for sale in the U.S. at AMAZON.com at least as early as Jun. 24, 2020, available online at https://www.amazon.com/Motorcycle-Protector-Protective-Protector-Accessories/dp/B08BT5WKDB/ref=sr_1_2_sspa?.

CPIDCL boot protector product, offered online for sale in the U.S. at AMAZON.com at least as early as Mar. 23, 2018, available online at https://www.amazon.com/Motorcycle-Shifter-Wear-resistant-Protector-Antiskid/dp/B07BNGBXF2/ref=asc_df_B07BNGBXF2/?.

Krace motorcycle 1PC shifter shoe protector, offered online for sale in the U.S. at AMAZON.com at least as early as Dec. 10, 2019, available online at https://www.amazon.com/Motorcycle-Protector-Motorbike-Protection-Accessories/dp/B082M91DY6/ref=sr_1_12?dchild=1 &keywords-motorcycle%2Bshoe%2Bprotector&qid=1628564123&sr=8-12&th=1, last visited Oct. 28, 2021.

* cited by examiner

FOOTWEAR PROTECTORS AND RELATED METHODS

CROSS REFERENCE TO RELATED APPLICATIONS

This document claims the benefit of the filing date of U.S. Provisional Patent Application No. 63/059,910, entitled "Footwear Protector," naming as first inventor Jacob Scott Turnblom, which was filed on Jul. 31, 2020, the disclosure of which is hereby incorporated entirely herein by reference.

BACKGROUND

1. Technical Field

Aspects of this document relate generally to footwear protectors. Specific implementations relate to devices useful for protecting footwear that would otherwise come in contact with machinery such as a motorcycle shifter.

2. Background Art

Using one's foot to actuate a mechanism, such as by non-limiting example a shifter on a motorcycle or some other mechanism, can result in damage or unwanted marking(s) on footwear. Some footwear protectors exist in the art but are slow to put on and/or take off or are otherwise inconvenient to use. Some footwear protectors result in a loose or sloppy fit. Some footwear protectors do not add rigidity to a user's footwear to help the user to comfortably operate a mechanism/shifter with a foot. Current footwear protectors lack satisfactory fitment on a large variety of shoe sizes and types. Current footwear protectors which primarily protect the top of footwear with one or more segments of material which wrap around the forward portion of a foot also utilize/include a supplementary attachment, attaching in a direction substantially perpendicular to a first material wrapping direction (in other words, attaching in a direction substantially parallel with a longest length of the footwear). These supplementary attachment methods include one or more lengths of material around the rear of the shoe and/or an attachment tab or feature which attaches to footwear laces.

SUMMARY

The present invention seeks to provide a solution to the above mentioned problems by providing a footwear protector comprising a substantially flat and elongate wrap with at least one feature on or near at least one end of the device to be affixed to a user's foot, footwear, or other worn clothing or accessory on or near a user's foot. The affixed feature(s) provide an anchor point, for the user to apply varying amounts of tension against, while the protector is wrapped around one's foot/footwear. The secondary end is subsequently affixed in place, such as using hook-and-loop fasteners, maintaining the placement and tension of the footwear protector.

General details of the above-described implementations, and other implementations, are given below in the DESCRIPTION, the DRAWINGS, and the CLAIMS.

BRIEF DESCRIPTION OF THE DRAWINGS

Implementations will be discussed hereafter using reference to the included drawings, briefly described below, wherein like designations refer to like elements. The drawings are not necessarily drawn to scale.

DESCRIPTION

Implementations/embodiments disclosed herein (including those not expressly discussed in detail) are not limited to the particular components or procedures described herein. Additional or alternative components, assembly procedures, and/or methods of use consistent with the intended footwear protectors and related methods may be utilized in any implementation. This may include any materials, components, sub-components, methods, sub-methods, steps, and so forth.

Figure 1:
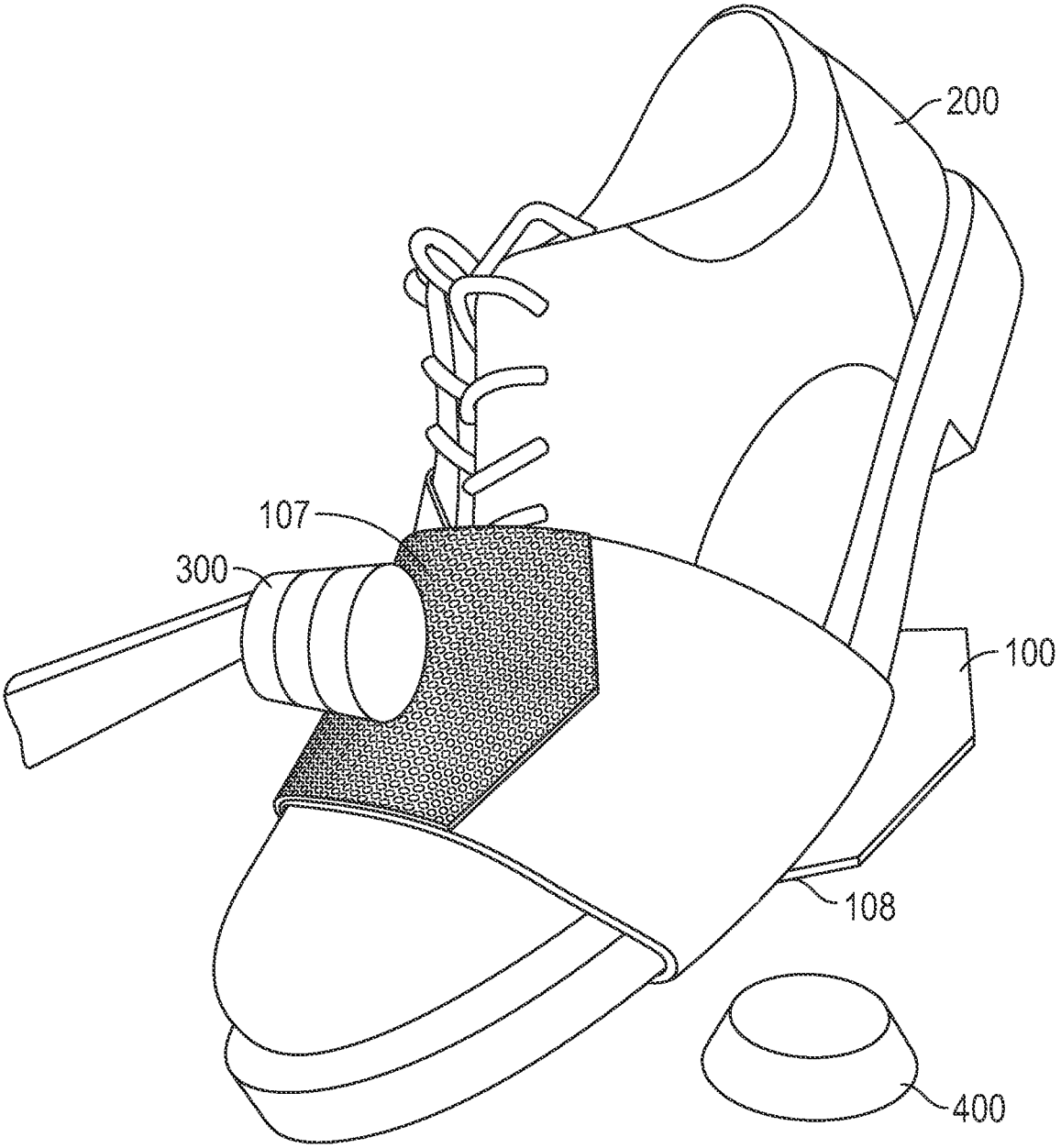
FIG. 1 is a perspective view of an implementation of a footwear protector coupled with footwear and shown in an environment of use which includes mechanisms/devices to be contacted/moved by the footwear.
Figure 4:
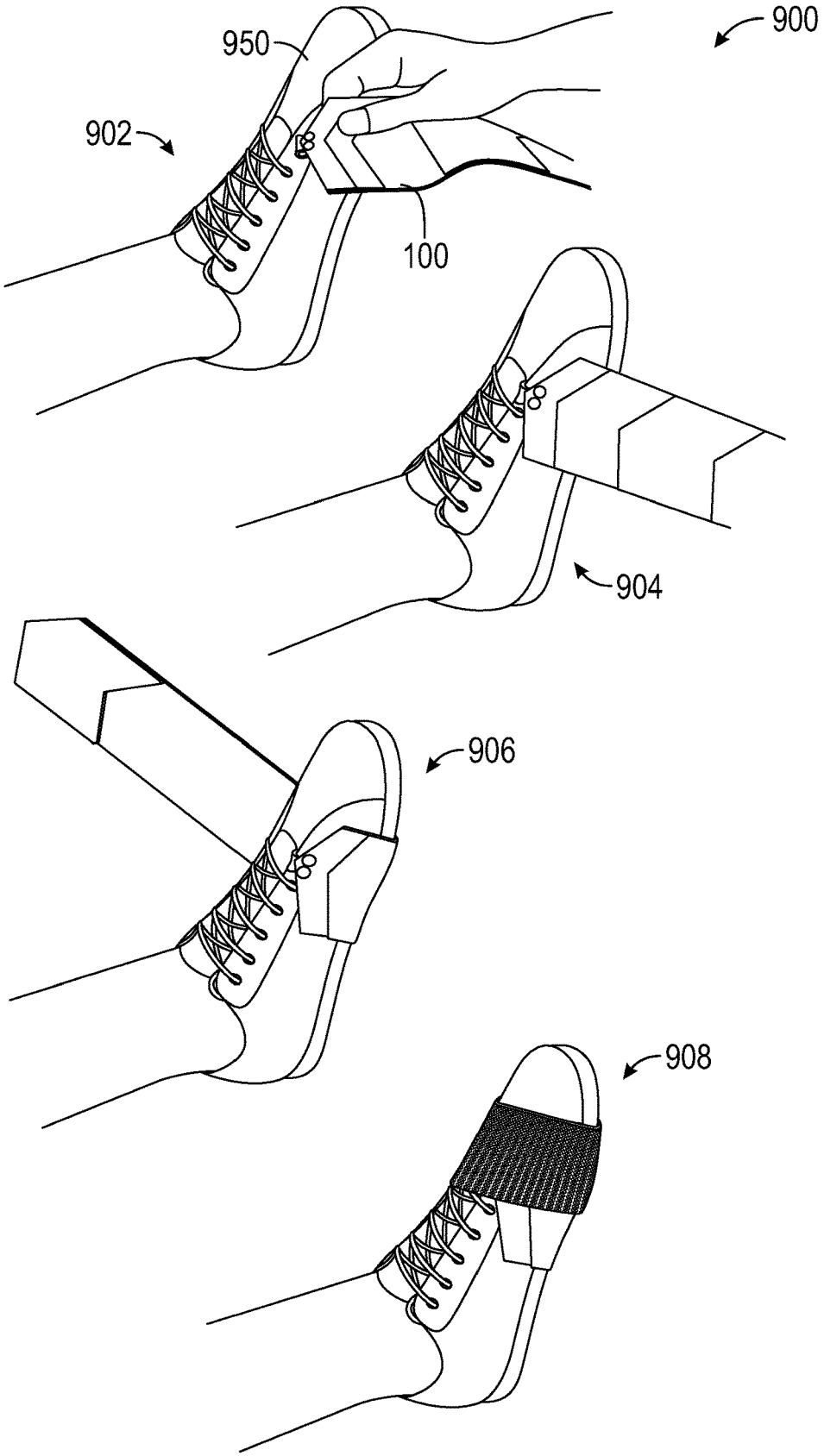
FIG. 4 representatively illustrates steps of a method of use of the footwear protector of FIG. 1.

Referring now to FIGS. 1-2 and 4, a footwear protector (protector) 100 is illustrated. In implementations the footwear protector includes a coupler 102 on one end for the user to quickly attach it to a shoelace or edge of material on a shoe (such as, by non-limiting example, an edge of footwear proximate shoelace holes). In implementations the coupler is (or includes) a hook, as in the drawings. The intent of the coupler is to allow the user to quickly anchor one end of the footwear protector in place, allowing the user to apply and maintain tension to the protector as the user wraps it around footwear, such as footwear item 200 (which is seen as a dress shoe) or footwear item 950 (which is seen in FIG. 4 as an athletic or casual shoe)—any type of footwear could be used (boots, slippers, high-heels, any type of shoe, etc.). The opposite end of the footwear protector (opposite the coupler) can then be secured after wrapping is complete, by connecting the opposite end to a portion of the protector itself (such as with hook-and-loop fasteners), or the opposite end could include another coupler/hook, a magnet, a reusable adhesive portion, a clip, a button, a zipper, or any other coupling mechanism for coupling with a portion of the protector itself or with the footwear.

Figure 2A:
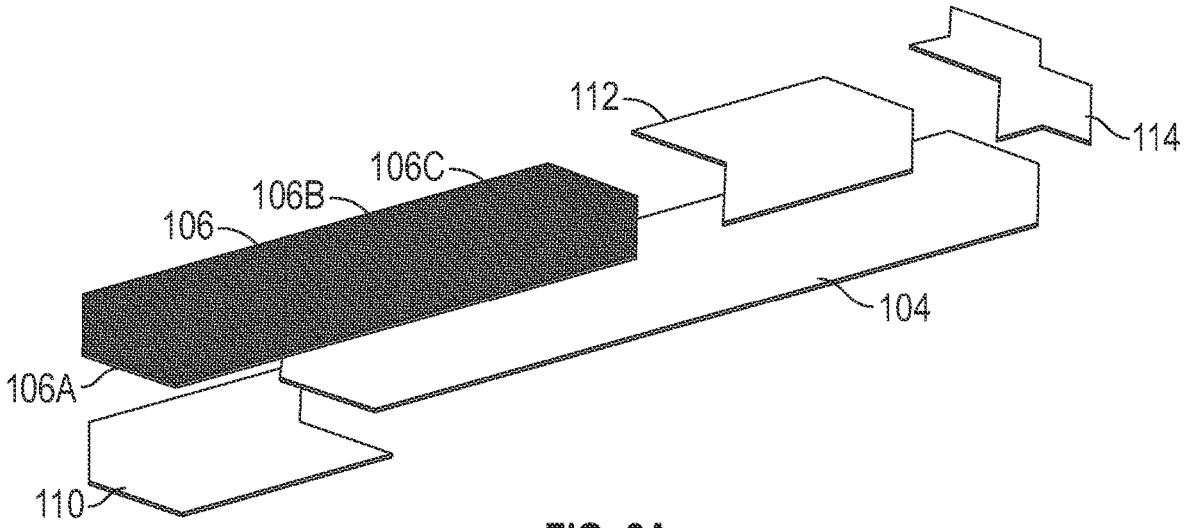
FIG. 2A is a top perspective exploded view of components of the footwear protector of FIG. 1.
Figure 2B:
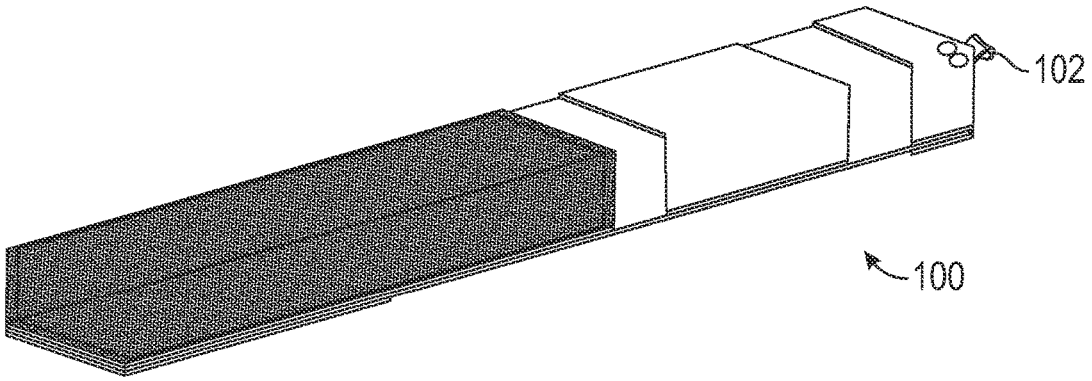
FIG. 2B is a top perspective view of the footwear protector of FIG. 1
Figure 2C:
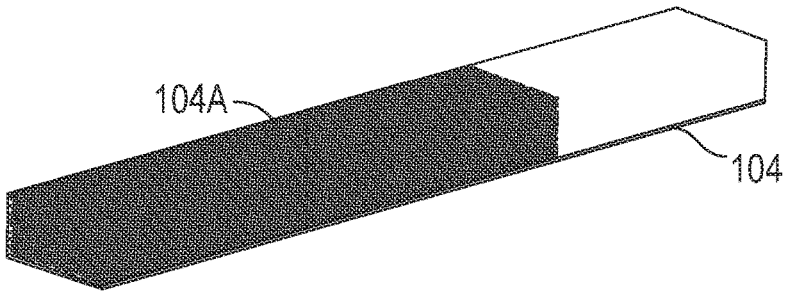
FIG. 2C is a top perspective view of an alternative configuration of an elastic layer of the footwear protector of FIG. 1.

Referring now to FIGS. 2A and 2B, various components of protector 100 are shown. FIG. 2A shows the protector in exploded view (disassembled) while FIG. 2B shows the protector fully assembled. The protector may include various layers, being formed of different materials coupled together such as using an adhesive, stitching, or other coupling mechanisms. The coupler 102 is seen in FIG. 2B (though it is not shown in FIG. 2A)—this can be used on or near one end of the protector to affix the protector to an item of footwear via a shoelace, edge, or fold of material.

Coupler 100 includes an elastic layer 104 formed into a narrow band. This is used to provide stretch and tension for accommodating various shapes and sizes of feet and footwear, and to allow a user to determine how tight to secure the protector when worn. The elastic layer may be formed of any elastic material such as, by non-limiting examples, a neoprene sheet, polyester elastic, woven cotton elastic, and so forth. An abrasion-resistant layer 106 can be coupled with the elastic layer so that it covers high wear and impact areas. For example, in FIG. 1 the abrasion-resistant layer may form a first contact area 107 (for contacting a device at the top of the footwear) and a second contact area 108 (for contacting a device at the bottom of the footwear). The abrasion-resistant layer could be formed of any abrasion-resistant textile or material such as, by non-limiting examples, rubber sheet, a fabric 106A with abrasion-resistant spots 106B or shaped abrasion-resistant material 106C applied thereon such as silicone or an abrasion-resistant resin, and so forth. In implementations, as in FIG. 2C, instead of an abrasion-resistant layer, there will be abrasion-resistant dots 104A or the like printed/coupled/adhered directly onto the elastic layer. Referring back to FIG. 2A, a first fastener layer 110 and second fastener layer 112 may be used to couple to one another to secure the protector around footwear. The fastener layers may be, by non-limiting example, hook-and-loop fasteners. The protector may also include one or more cosmetic layers 114 which may be used for cosmetic, aesthetic, or branding purposes. By comparing FIG. 2A to FIG. 2B it can be seen that the elastic layer is not completely covered by layers 106, 112 and 114, which allows the uncovered portions of the elastic layer to have more "give" to allow stretching (though the portions of the elastic layer coupled with other layers may still have some give as well). It is also seen by comparing FIG. 2A to FIG. 2B that layer 114 is folded over the end of layer 104 to form a chevron shape on both sides of layer 104.

Referring back to FIG. 1, a first mechanism/device 300 and a second mechanism device 400 are shown. Mechanism/device 300 is a device the user would contact or actuate with the top of the foot (for example this could be a shifter on a motorcycle or some other element). The contact area 107 creates a protective barrier between the user's footwear and mechanism/device 300, thus protecting the user's footwear from damage or marks, while also adding rigidity. Mechanism/device 400 is an example object or mechanism which the user would contact or actuate with the bottom of the foot or footwear. The contact area 108 creates a protective barrier in this area between the user's footwear and the object or mechanism being contacted, protecting the user's foot/footwear from potential damage or marks.

Figure 3:
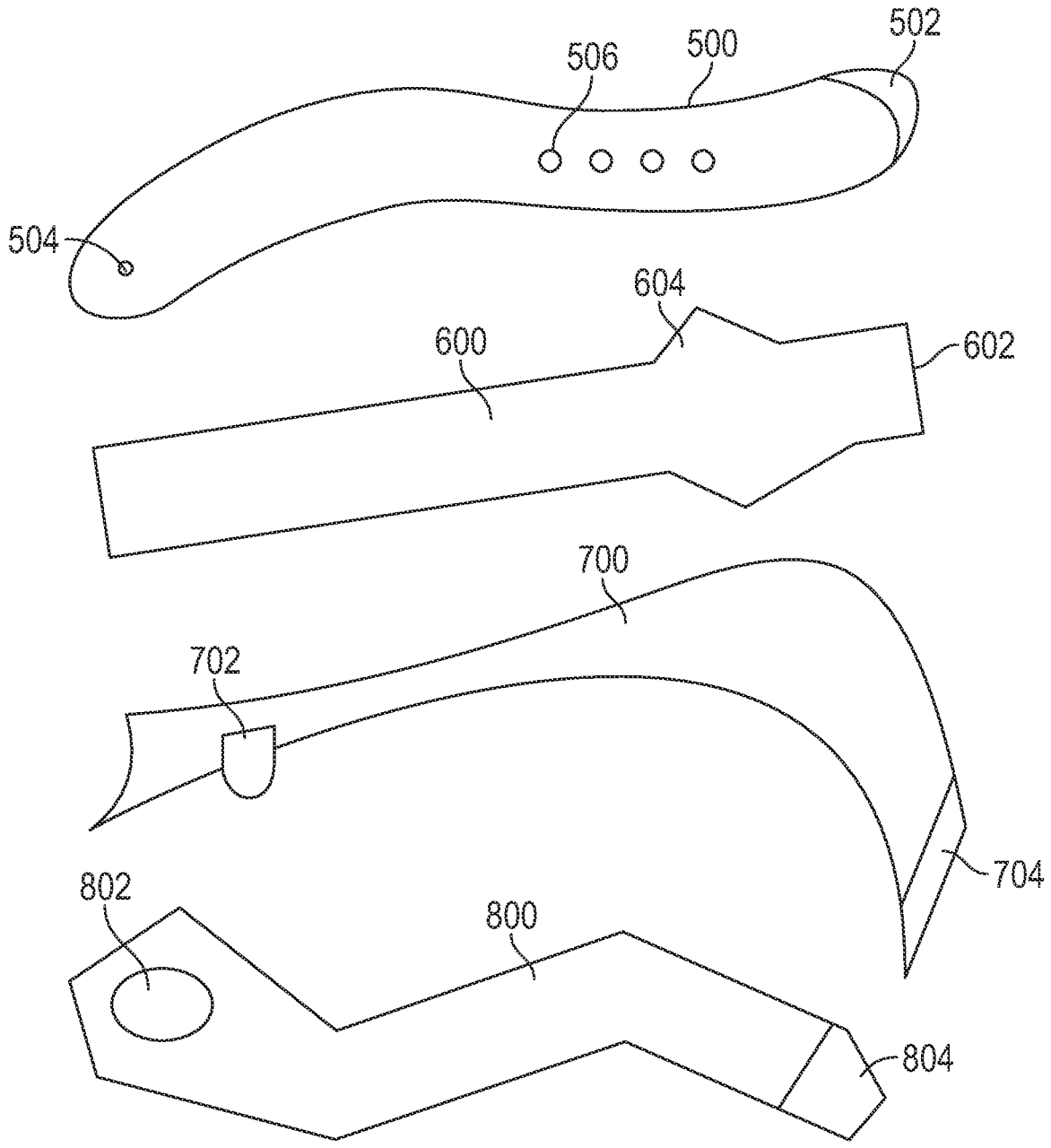
FIG. 3 is a top view of four other implementations of footwear protectors.

FIG. 3 shows additional implementations of footwear protectors, using different shapes and different securing mechanisms and other elements. These are shown from a top perspective as if each is lying flat on a flat surface. Footwear protector 500 has prominent curvature and includes a cap 502 forming a cavity which slips over a user's toe or heel (i.e., of footwear) to anchor that end of the protector in place. A protrusion 504 proximate the other end could mate with holes/cavities 506 along the body as commonly seen on belts for trousers.

Footwear protector 600 may be formed of a material having substantial surface grip and the portion proximate the first end 602 with wings 604 may be used to anchor this end in place during wrapping. In this implementation there may be hook-and-loop fastener material exposed on both sides of the end opposite end 602 (or otherwise on a majority of both sides of the protector) to allow the protector to be wrapped and attached to itself easily.

Footwear protector 700 may have a protruding tab 702 formed of hook-and-loop fastener material which may be used to surround a shoelace to affix one end of the protector thereto. A crevice/fold 704 on the opposite end of the protector (which may be formed of a rigid plastic or another rigid material) may hold an edge of material of the footwear, the user's clothing, or the invention itself to secure the protector to footwear.

Footwear protector 800 includes a through-hole 802 to affix a first end of the protector in place. Non-limiting examples of its placement could be around a user's ankle, over the toe of an item of footwear, or over/around a user's heel. An adhesive 804 at the other end of the protector (which may be similar to an adhesive tape-like surface) is used to affix the protector to a secured configuration once wrapping is complete.

FIG. 4 representatively illustrates a non-limiting example of a method of use of footwear protector 100 with a footwear item (footwear) 950. The method 900 includes step 902 of hooking the coupler 102 with a shoelace or edge of material. In implementations in which a user is using the footwear protector to protect footwear used for shifting, the user would hook the coupler on the shifter-side footwear with the slack inward (towards the other foot). At step 904 the user pulls the protector snug and begins wrapping it around the footwear. At step 906 the user wraps the protector under the footwear, maintaining tension and keeping at least a portion of the fastener layer 112 on the bottom of the footwear. During this step the user would pull in a semi-forward direction (somewhat towards the toe), a little forward of the coupler, and wrap the protector around the bottom of the footwear with the abrasion-resistant layer 106 at the bottom of the footwear where the shifter would be contacted. At step 908 the user finishes by wrapping the protector over the top of the footwear with the tail end (opposite the coupler 102 end) at least partially under the footwear, while pulling the protector slightly rearward (heel-ward) and then securing the fastener layer 110 to the fastener layer 112, ensuring good fastener contact and a snug fit overall.

The coupler 102 allows the user to very quickly couple the protector to a shoe to begin the wrapping process. The flexible nature of the protector (or at least the flexible portions) allow it to fit a multitude of different footwear types and sizes (dress shoes, running shoes, boots—basically any type of shoe or footwear) and it also adds rigidity to softer shoes (for example where it might hurt to shift if the user is wearing something a little flimsier like a cloth shoe). The coupler can be used to couple to a shoelace or an edge or piece of material, but really whatever the coupler can couple to. The reason the method of use/attachment includes pulling the protector forward while going under the footwear and then pulling backward while going over the footwear is because this ensures that the tension is pulling the protector back towards the slope of the foot. If the protector is loose or neutral (not biased backward) it can slide towards the toe and off the foot. Accordingly, it is useful to tension it by pulling forward under the footwear and then backward over the footwear during wrapping. The user can try the wrapping technique a few times to get the tension right. The user can test the wrapping by placing the foot on the ground and dragging the foot backwards. If the wrap slides off, then the tension was not correct or the protector was not wrapped tightly enough.

Because the footwear protectors are basically flat and easily foldable/rollable, and small, they have a very low profile and can easily be stored out of the way when not in use—such as in a pocket or an unused helmet. In general there is nothing sticking out of the protectors that could snag somewhere or otherwise cause issues. The protectors are completely form-fitting so they can match any footwear, are hardly noticeable during use, and can be made in a variety of colors to match footwear and be even less noticeable.

In places where the phrase "one of A and B" is used herein, including in the claims, wherein A and B are elements, the phrase shall have the meaning "A and/or B." This shall be extrapolated to as many elements as are recited in this manner, for example the phrase "one of A, B, and C" shall mean "A, B, and/or C," and so forth. To further clarify, the phrase "one of A, B, and C" would include implementations having: A only; B only; C only; A and B but not C; A and C but not B; B and C but not A; and A and B and C.

In places where the description above refers to specific implementations of footwear protectors and related methods, one or more or many modifications may be made without departing from the spirit and scope thereof. Details of any specific implementation/embodiment described herein may, wherever possible, be applied to any other specific implementation/embodiment described herein. The appended claims are to encompass within their scope all such changes and modifications as are within the true spirit and scope of this disclosure.

Furthermore, in the claims, if a specific number of an element is intended, such will be explicitly recited in the claim, and in the absence of such explicit recitation no such limitation exists. For example, the claims may include phrases such as "at least one" and "one or more" to introduce claim elements. The use of such phrases should not be construed to imply that the introduction of any other claim element by the indefinite article "a" or "an" limits that claim to only one such element, and the same holds true for the use in the claims of definite articles.

Additionally, in places where a claim below uses the term "first" as applied to an element, this does not imply that the claim requires a second (or more) of that element—if the claim does not explicitly recite a "second" of that element, the claim does not require a "second" of that element. Furthermore, in some cases a claim may recite a "second" or "third" or "fourth" (or so on) of an element, and this does not imply that the claim requires a first (or so on) of that element—if the claim does not explicitly recite a "first" (or so on) of that element, the claim does not require a "first" (or so on) of that element.

What is claimed is:

1. A footwear protector, comprising:

an elastic layer;

an abrasion-resistant element coupled with the elastic layer;

a plurality of fastener layers coupled with the elastic layer, each of the fastener layers covering a full width of the elastic layer in at least one direction;

a coupler coupled with at least one of the layers and configured to couple with a portion of footwear; and an additional layer that is folded over an end of the elastic layer to at least partially cover two sides of the elastic layer.

2. The footwear protector of claim 1, wherein the elastic layer has a shape of a rectangle capped on two sides with triangles.

3. The footwear protector of claim 1, wherein the elastic layer has a shape of an irregular hexagon.

4. The footwear protector of claim 3, wherein four sides of the hexagon have lengths substantially equal to one another and wherein two sides of the hexagon have lengths substantially equal to one another but longer than the lengths of the four sides.

5. The footwear protector of claim 3, wherein the additional layer covers two sides of the hexagon.

6. The footwear protector of claim 1, wherein the abrasion-resistant element comprises an abrasion-resistant layer covering a full width of the elastic layer.

7. The footwear protector of claim 6, wherein the abrasion-resistant layer covers the full width of the elastic layer in the at least one direction.

8. The footwear protector of claim 1, wherein the abrasion-resistant element comprises one of a fabric with abrasion-resistant material applied thereon and abrasion-resistant deposits adhered directly onto the elastic layer.

9. The footwear protector of claim 1, wherein the abrasion-resistant element is sized to simultaneously cover a portion of a bottom of the footwear and a portion of a top of the footwear when the footwear protector is secured around the footwear.

10. A footwear protector, comprising:

an elastic layer having a shape of a rectangle capped on two opposite sides with triangles;

an abrasion-resistant element coupled with the elastic layer;

a plurality of fastener layers coupled with the elastic layer;

a coupler coupled with at least one of the layers and configured to couple with a portion of footwear; and;

an additional layer that is folded over an end of the elastic layer to at least partially cover two sides of the elastic layer.

11. The footwear protector of claim 10, wherein the abrasion-resistant element comprises one of an abrasion-resistant dots adhered directly onto the elastic layer and an abrasion-resistant layer covering a full width of the elastic layer in at least one direction.

12. The footwear protector of claim 10, wherein at least one of the fastener layers covers a full width of the elastic layer in at least one direction.

* * * * *